United States Patent [19]

Tillman nee Caruso et al.

[11] Patent Number: 4,893,057

[45] Date of Patent: Jan. 9, 1990

[54] HIGH INTENSITY DISCHARGE LAMP AND ELECTODES FOR SUCH A LAMP

[75] Inventors: Nancy J. Tillman nee Caruso, Perry; Philip J. Nalepa, Painted Post, both of N.Y.

[73] Assignee: North American Philips Corp., New York, N.Y.

[21] Appl. No.: 799,273

[22] Filed: Nov. 18, 1985

Related U.S. Application Data

[63] Continuation-in-part of Ser. No. 493,175, May 10, 1983, abandoned.

[51] Int. Cl.[4] ..... H01J 61/073

[52] U.S. Cl. ..... 313/631; 313/344

[58] Field of Search ..... 313/631, 632, 633, 344

[56] References Cited

U.S. PATENT DOCUMENTS

| | | | |
|---|---|---|---|
| 2,007,947 | 7/1935 | Braselton | 313/631 X |
| 3,937,996 | 2/1976 | Cap | 313/631 |
| 4,105,908 | 8/1978 | Harding et al. | 313/631 |
| 4,150,317 | 4/1979 | Laska et al. | 313/631 |
| 4,340,836 | 7/1982 | Bergman et al. | 313/631 |

FOREIGN PATENT DOCUMENTS

| | | | |
|---|---|---|---|
| 2535922 | 3/1977 | Fed. Rep. of Germany | 313/631 |

*Primary Examiner*—Kenneth Wieder

*Attorney, Agent, or Firm*—Emmanuel J. Lobato

[57] ABSTRACT

An HID lamp incorporates all-metal electrodes providing rapid transition of the arc to the electrode tip. The electrode comprises a length of thoriated tungsten wire having a close wrapped coil between connection and tip ends, so that rapid heating of the electrode tip promotes rapid transition of the arc from coil crevices to the tip.

4 Claims, 2 Drawing Sheets

HIGH INTENSITY DISCHARGE LAMP AND ELECTODES FOR SUCH A LAMP

This is a continuation-in-part of application Ser. No. 493,175, filed May 10, 1983, now abandoned.

BACKGROUND OF THE INVENTION

1. Field of the Invention

The invention relates to high intensity discharge lamps having tungsten or thoriated tungsten main electrodes; and more particularly, to discharge lamps whose electrodes include a crevice-forming coil of tungsten wire.

As interest in development of light sources with improved color characteristics has grown, and the use of many different metal halide additives to the lamp filling material has been investigated, a variety of problems affecting lamp life and lamp-to-lamp uniformity have arisen. Various attempts at improving this situation have been suggested over the years, and an improved high color rendering metal halide lamp and method of manufacturing it is disclosed in the concurrently filed application by applicant and Michael H. Masto, hereby incorporated by reference.

2. Description of the Prior Art

Electrodes for metal halide high intensity discharge lamp are well known, and commonly comprise a thoriated tungsten core extending between a molybdenum strip in the press seal of the arc tube and a tip from which the arc is desired to burn during operation, and a coil of a few turns of tungsten wire, generally of a same or smaller diameter than the core, wound tightly about the core a short distance from the tip. When an arc is first struck within the lamp, the arc usually initiates at one of the crevices formed by the coil of wire; good operation and life of the bulb requires that preferably within five seconds, and certainly within fifteen seconds, that the arc spot transfer to the tip of the electrode. However, inefficient transfer of the hot spot from the coil to the thoriated tip has long been known as a source of instability in metal halide discharge lamps.

Another problem observed in the prior art is the blackening of discharge envelope wall, apparently due to the deposition of tungsten which has been evaporated from the electrodes; this effect has been described as particularly marked when scandium iodide is one of the additives. U.S. Pat. No. 4,232,243 describes this effect, and one solution to it by which each electrode is formed with a cavity, and the cavity is filled with a glassy or solidified melt substantially filling the cavity and adhering to the electrode structure, this solidified melt being an activator material consisting essentially of scandium oxide. As described in that patent, the presence of the scandium oxide facilitates rapid starting of the discharge, and provides a luminous efficacy equal to that obtained with unactivated tungsten electrodes. To reduce blackening of the envelope, this patent teaches the addition of a metal bromide to the additives in the lamp, and the use of a tungsten wire electrode instead of the more common thoriated tungsten.

Finally, metal halide lamps are characterized by reignition voltage spikes that develop after the lamp has warmed up. To facilitate starting and avoid excessive reignition voltage, the electrode coil should not compete with the electrode tip for arc formation. If the electrode design is such that the arc forms at the electrode coil as mentioned above, then the arc should transfer rapidly to the electrode tip and should extinguish at every other portion of the electrode.

SUMMARY OF THE INVENTION

The object of the invention is to provide a high intensity discharge lamp exhibiting a rapid transfer of arc spot from the coil to the tip of the electrode.

A further object of the invention is to provide an electrode for a high intensity discharge lamp which is easily manufactured using common filament winding machinery.

According to the invention, a lamp is provided having main electrodes which are all metallic and each comprise a length of wire having a tip end and a connection end extending generally parallel to each other, between said tip end and said connection end the length of wire comprising a portion formed as a helical coil having a plurality of closely spaced turns.

In a preferred embodiment of the invention, the electrodes are formed of a length of thoriated tungsten wire having a circular cross-section, with an inside coil diameter greater than the wire diameter.

In another preferred embodiment, the electrode coil has its axis skewed with respect to the tip and connection ends. In still another embodiment incorporating that feature, the electrode made of thoriated tungsten wire includes a core slug which is a tungsten cylinder having a length approximately equal to the length of the coil, the coil fitting snugly about the cylinder.

In an alternative embodiment of the invention, the electrode comprises a thoriated tungsten wire whose tip and connection ends are coaxial with the coil.

As a result of the unitary construction of the coil and electrode tip, transfer of the arc spot from the coil to the electrode tip is speeded because there is no temperature drop between the coil and the electrode tip caused by poor thermal contact. Further, by practice of this invention a thoriated tungsten electrode is made possible, which exhibits rapid transfer of the arc to the tip while at the same time providing the thoriated-tungsten freedom from pitting and erosion of the electrode tip, which erosion leads to arc tube blackening.

DESCRIPTION OF THE PREFERRED EMBODIMENTS

Lamp Construction

Figure 1:
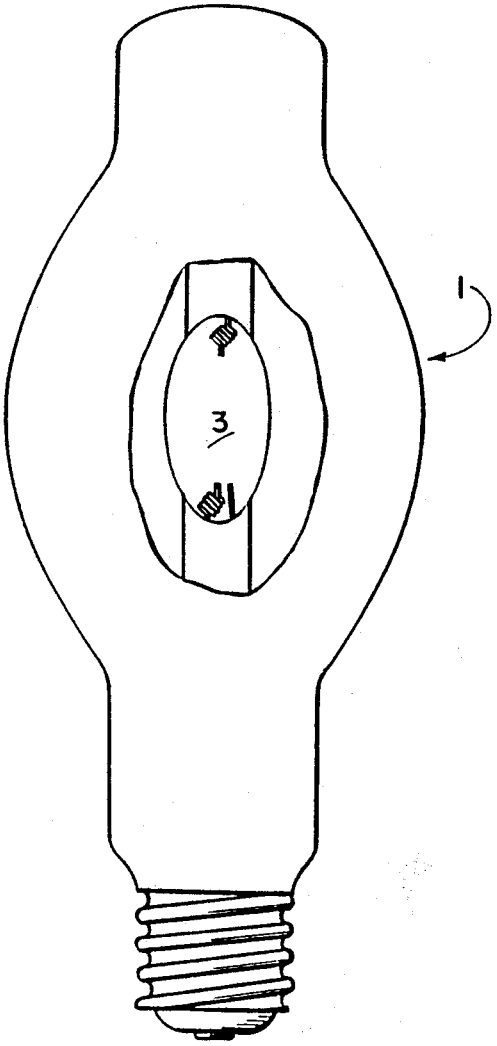
FIG. 1 illustrates an electric discharge lamp, partially in section, of the type in which electrodes according to the invention are used.

The high intensity discharge lamp shown in outline in FIG. 1 is generally of a type which may be suitable for a 250 Watt metal halide lamp in accordance with the invention, and uses a BT 28 bulb and base. The arc tube 3, shown only diagrammatically in this view, is supported within the lamp envelope, and has electrical connections to the arc tube made in any of the manners well known in the art. The outer bulb is, preferably, evacuated.

Figure 2:
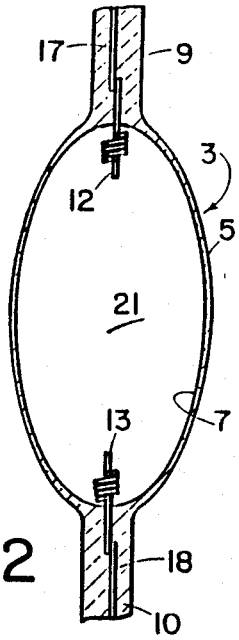
FIG. 2 is a longitudinal section of the arc tube assembly of the lamp shown in FIG. 1.
Figure 3:
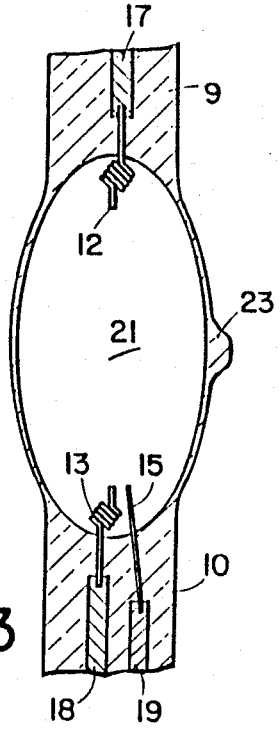
FIG. 3 is a different longitudinal section of the arc tube assembly shown in FIG. 2.

The inventive arc tube, shown more particularly in FIGS. 2 and 3, includes a quartz vessel 5 having an approximately ellipsoidal inner surface 7 with pressed ends 9, 10. Inserted into the pressed ends are main electrodes 12, 13, which in the preferred embodiment are identical, and a starter electrode 15.

The electrode 12, consisting of a length of thoriated tungsten wire as more fully discussed below, is inserted into the pressed end 9, and welded to a molybdenum strip 17. Similarly, the main electrode 13 and starter electrode 15 are inserted in the pressed end 10 and are welded to respective molybdenum strips 18, 19.

To provide a highly isothermal construction, the dimensions of the vessel 5 and the insertion of the electrodes 12, 13 provide a relatively long arc with respect to the vessel cavity. In a preferred embodiment for 250 Watt operation, the tip-to-tip spacing of the electrodes 12, 13 is 24 mm, while the inner surface 7 describes an ellipsoid having a major diameter or length of 34 mm, and a minor diameter of 16 mm, the cross-section of the vessel taken transversely to the longitudinal axis being circular. For operation with the pressure and power rating listed below, the vessel is selected to have a wall thickness of approximately 1 mm.

A preferred additive for such a lamp utilizes 0.4 mg of thallium iodide, 5.5 mg of calcium iodide and 2.5 mg of tin iodide.

Electrodes

Figure 4:
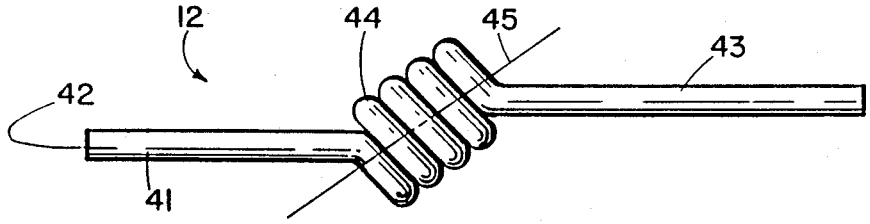
FIG. 4 illustrates a coiled discharge electrode.

To ensure that, during operation, the arc makes the transition from the coil where it initially terminates, to the electrode tip, and then maintains an efficient "hot spot" operation on the tip, in a preferred embodiment of the lamp the electrodes 12, 13 are formed as shown in FIG. 4. Rather than comprising a thoriated tungsten central post, about which some turns of tungsten wire have been wound tightly in order to provide cavities for arc initiation, the electrode is a unitary element formed of a length of a thoriated tungsten wire. An electrode which can readily be fabricated using conventional equipment has a tip end 41, whose end face 42 is the tip at which hot spot operation is desired. Opposite the tip end, a connection end 43 is provided of such length that it can be conventional welded to a molybdenum strip for insertion into the pressed end of the arc tube. Between these ends, the length of wire is wound as a coil 44, which preferably has an inside diameter (winding mandrel diameter) slightly greater than the wire diameter. To avoid sharp bends in the wire, and to permit use of conventional coil winding equipment, the ends 41 and 43 extend at an angle with respect to the axis 45 of the coil portion. Preferably, the end portions 41 and 43 emerge from the coil 44 at a distance from the coil axis 45 the same as the distance of the coil 44 from the axis 45. Preferably these ends 41 and 43 are parallel to each other, so that alignment of the electrode in the pressed end of the arc tube is simplified, it being desirable that the tip 42 of the electrode be on the longitudinal axis of the ellipsoid.

For use in a 250 Watt metal halide lamp, the presently preferred dimensions involve 0.53 mm (0.021") wire diameter, having 4¼ turns wound about a 0.76 mm (0.030") mandrel with approximately 105% pitch. The tip extends approximately 2 mm from the coil. The electrode wire used has the same composition as that used for the prior art electrode posts, typically a thoriated tungsten containing from 1% to 1½% thorium. Where, in a lower power lamp, a smaller diameter wire is desirable, a smaller number of turns such as approximately 3 turns may be preferable.

Figure 5:
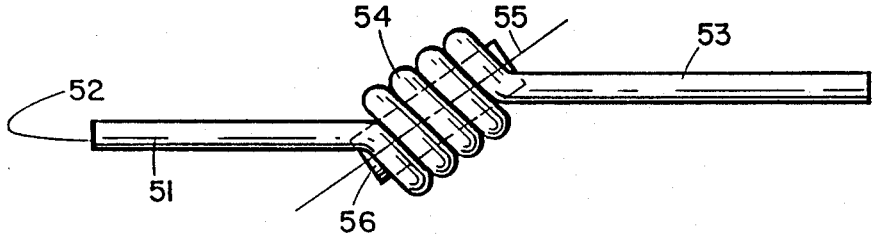
FIG. 5 illustrates a coiled discharge electrode according to the invention.

In order to provide additional cavity spots at which arc termination may initiate, according to another electrode embodiment shown in FIG. 5 a wound element having tip end 51, tip 52, connection end 53 and coil 54 on an axis 55 is prepared as in FIG. 4, and a tungsten slug or core 56 is then inserted within the coil 54. The core slug preferably has a diameter such that the coil fits tightly about the slug and is approximately the same length or may extend slightly beyond the full turns of the coil.

Figure 6:
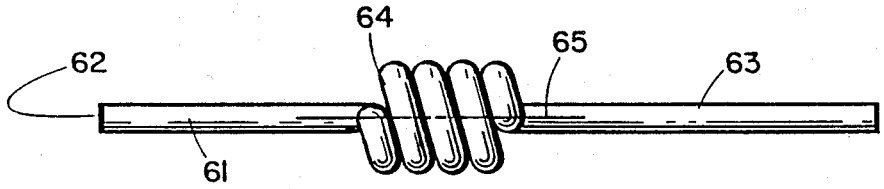
FIG. 6 illustrates another coiled discharge electrode.

It will be clear that symmetrical formation of the electrode for mounting in the arc tube is preferable, so that the electrode shape shown in FIGS. 4 and 5 represents a production compromise. A unitary electrode shown in FIG. 6 has a tip end 61, with tip 62, coaxial with a connection end 63 and the axis 65 of the coil 64. This construction requires relatively sharp bends in the wire at the transitions from the coil to the connection and tip ends, as is well known to those experienced in the filament winding art. According to yet another embodiment, not shown separately in the drawing, an electrode similar to that of FIG. 6 may be prepared having a short core inserted within the coil after winding the basic turns, and before forming the two ends to the coaxial position. Such a construction offers not only additional cavities for arc initiation, but will also provide support for the coil during the process of forming the transitions to the connection end 63 and the tip end 61.

EXAMPLE 1

Four metal halide 400 watt lamps were made using electrodes according to the invention. In three of the lamps both electrodes had the continuous wire structure of the invention. In the fourth lamp the electrode in the salts end of the arc tube had the standard rod and coil structure while the electrode at the starter end had the continuous wire structure of the invention. The electrode structure eliminated or substantially reduced the reignition voltage spike that would normally be present.

Six Hours: After six hours of operation the three lamps having identical electrodes exhibited no reignition voltage spikes, or at most a nominal spike of 30 to 40 volts peak with eight volts drop back. The fourth lamp with the one standard electrode exhibited a classic reignition voltage spike on alternate half cycles of lamp voltage when the standard electrode was biased to operate as the lamp cathode. The reignition voltage spike was 140 volts peak with 110 volts drop back. The average photometric data for the four lamps operating at 134 volts was 34,000 lumens and a corrected color temperature of 3317° K.

400 Hours: After 400 hours operation one of the lamps having identical electrodes exhibited a small reignition voltage spike of 80 volts peak with eight to ten volts drop back. The average photometric data for the three lamps with identical electrodes operating at a nominal 133 volts was 30,600 lumens and a color corrected temperature of 3400° K. The reignition voltage spike on alternate half cycles for the lamp having different electrodes remained.

700 Hours: At 700 hours of operation some of the lamps exhibited starting voltage noise of about 40 to 50 seconds duration. Visual inspection of these lamps when extinguished revealed roughening of the first turn of the electrode coil closest to the electrode tip. The electrodes were hand wound and somewhat asymmetrical. It is believed that the coil turn facing the electrode tip competed with the tip for arc formation and this caused surface erosion of the coil turn and gave rise to the starting voltage noise. These lamps did not exhibit a reignition voltage spike. The lamp having two different electrodes continued to exhibit the reignition voltage spike on alternate half cycles of operation.

1500 Hours: At 1528 hours of operation one of the lamps having identical electrodes exhibited a reignition voltage spike. This lamp had developed an extremely roughened first coil turn, and possibly the arc remained attached to the electrode at the coil. The lamp having two different electrodes continued to exhibit the reignition voltage spike on alternate half cycles of operation.

EXAMPLE 2

A metal halide 400 watt lamp was made having a standard rod and coil electrode at the starter electrode end of the arc tube, and a continuous wire electrode according to the present invention at the salts end of the arc tube. At 100 hours of operation this lamp exhibited a reignition voltage spike of 100 volts peak with a drop back of 10 volts, when the standard electrode was biased as the lamp cathode. No reignition voltage spike occurred when the continuous wire electrode was biased as the cathode.

The electrodes described in Example 1 were made from Tungsten wire having 1% $ThO_2$ (thoria). In order to improve lamp maintenance, a preferred electrode material is a fine uniform dispersion of 1.5% thoria in tungsten, having an average thoria particle size of less than 0.1 microns.

It will be clear to those of ordinary skill in the HID art that variations of the above described embodiments are possible within the spirit of the invention. For example, other additives to the tungsten in place of or in addition to thorium may become known and advantageous. Variations in the coil dimensions relative to the tip and connection ends may be based on preferred manufacturing practice or experience in particular shaped lamp vessels. Accordingly, the scope of the invention is to be measured by the appended claims.

What is claimed:

1. A high intensity discharge lamp comprising
an arc tube enclosing a space,
an ionizable material contained in said space,
at least two electrodes each extending to a tip, and arranged in said space for establishment of an arc between said tips, and
means for connecting said electrodes to a source of electric current,
characterized in that said electrodes each are all metallic and consist essentially of a length of wire having a straight tip end and a connection end, a first portion of said length adjoining said straight tip end and a second portion of said length adjoining said connection end, each portion being a straight portion, and said portions extending generally parallel to each other, arranged such that in normal operation the arc extends between said straight tip ends,
between said first portion and said second portion said length comprises a third portion formed as a helical coil having a plurality of closely spaced turns, said turns defining crevices arranged to permit easy lamp starting by initiation of an arc at one of the crevices, and subsequent transfer of the arc to the tip,
said wire has circular cross-section, and said coil has an inside diameter greater than the diameter of the wire,
the coil axis is skewed with respect to said straight tip and connection ends, and
said electrodes each further comprises a core slug comprising a metallic cylinder having a length approximately equal to the length of said coil, about which core slug said coil fits snugly.

2. A lamp as claimed in claim 1, characterized in that said core slug comprises tungsten, and said length of wire consists essentially of thoriated tungsten wire.

3. An electrode for a high intensity discharge lamp, said electrode being all metallic and consisting essentially of a length of wire having a straight tip end and a connection end, a first portion of said length adjoining said straight tip end and a second portion of said length adjoining said connection end, each portion being a straight portion, and said portions extending generally parallel to each other, wherein
between said first portion and said second portion said length comprises a third portion formed as a helical coil having a plurality of closely spaced turns,
said length of wire consists essentially of thoriated tungsten wire, and said coil comprises at least approximately three total turns and defines an axis skewed with respect to said straight tip and connection ends, said turns defining crevices arranged to permit easy lamp starting by initiation of an arc at one of the crevices, and subsequent transfer of the arc to the tip end, and
said electrode further comprises a core slug comprising a metallic cylinder having a length approximately equal to the length of said coil, about which core slug said coil fits snuggly.

4. An electrode as claimed in claim 3, characterized in that said core slug comprises tungsten.

* * * * *